US008701881B2

(12) United States Patent
Gibson et al.

(10) Patent No.: US 8,701,881 B2
(45) Date of Patent: Apr. 22, 2014

(54) CONTAINER

(75) Inventors: Paul Gibson, London (GB); Aaron McKenzie, London (GB)

(73) Assignee: British American Tobacco (Investments) Limited, London (GB)

( * ) Notice: Subject to any disclaimer, the term of this patent is extended or adjusted under 35 U.S.C. 154(b) by 0 days.

(21) Appl. No.: 13/131,510

(22) PCT Filed: Oct. 29, 2009

(86) PCT No.: PCT/EP2009/064284
§ 371 (c)(1),
(2), (4) Date: Aug. 15, 2011

(87) PCT Pub. No.: WO2010/060723
PCT Pub. Date: Jun. 3, 2010

(65) Prior Publication Data

US 2011/0290682 A1 Dec. 1, 2011

(30) Foreign Application Priority Data

Nov. 28, 2008 (GB) ..... 0821686.3

(51) Int. Cl.
*A24F 23/00* (2006.01)

(52) U.S. Cl.
USPC ..... 206/236

(58) Field of Classification Search
USPC ..... 206/242, 270, 818; 220/230, 522, 521, 220/524, 523, 483
See application file for complete search history.

(56) References Cited

U.S. PATENT DOCUMENTS

| | | | | | |
|---|---|---|---|---|---|
| 2,940,589 | A | * | 6/1960 | Silverman | 206/5 |
| 3,055,808 | A | * | 9/1962 | Henderson | 435/305.3 |
| 3,961,721 | A | | 6/1976 | Gordon et al. | |
| 4,098,421 | A | * | 7/1978 | Foster | 215/321 |
| 4,165,815 | A | * | 8/1979 | Vetter | 220/4.27 |
| 4,475,654 | A | * | 10/1984 | Fruchter | 206/538 |
| 4,804,101 | A | * | 2/1989 | Heath | 220/504 |
| 5,207,319 | A | * | 5/1993 | Hamada | 206/216 |
| 5,447,041 | A | * | 9/1995 | Piechota | 62/457.7 |
| 5,515,991 | A | * | 5/1996 | Heitland | 220/256.1 |
| 5,524,788 | A | * | 6/1996 | Plester | 220/522 |
| 5,769,263 | A | * | 6/1998 | Willingham et al. | 220/522 |
| 6,311,860 | B1 | * | 11/2001 | Reidinger et al. | 220/521 |

(Continued)

FOREIGN PATENT DOCUMENTS

| | | |
|---|---|---|
| CL | 131-1998 | 12/1998 |
| CL | 052-2001 | 11/2001 |

(Continued)

OTHER PUBLICATIONS

International Search Report and Written Opinion corresponding to PCT/EP2009/064284 mailed Mar. 5, 2010.

(Continued)

*Primary Examiner* — Steven A. Reynolds
*Assistant Examiner* — King M Chu
(74) *Attorney, Agent, or Firm* — N W Poulsen

(57) ABSTRACT

A container comprising a housing defining a main storage space and a lid attachable to the housing to close said main storage space is disclosed. The lid includes a central recess and a cover attachable to the lid to close the central recess so to define a secondary storage space. Furthermore, the cover is magnetically detachable from the lid.

17 Claims, 7 Drawing Sheets

(56) References Cited

U.S. PATENT DOCUMENTS

| | | | | |
|---|---|---|---|---|
| 6,460,287 | B1 * | 10/2002 | Louie | 43/54.1 |
| 7,011,228 | B2 | 3/2006 | Ordiway | |
| 7,172,101 | B2 * | 2/2007 | Find | 222/562 |
| 7,717,259 | B2 * | 5/2010 | Hatton | 206/236 |
| 2004/0206638 | A1 * | 10/2004 | Metzler et al. | 206/1.5 |
| 2006/0060480 | A1 * | 3/2006 | Budd | 206/266 |
| 2006/0175330 | A1 * | 8/2006 | Richardson | 220/212 |
| 2006/0283721 | A1 * | 12/2006 | Kutsch et al. | 206/39 |
| 2007/0131687 | A1 * | 6/2007 | Otto et al. | 220/212 |
| 2010/0193525 | A1 * | 8/2010 | Rosazza et al. | 220/524 |

FOREIGN PATENT DOCUMENTS

| | | | | |
|---|---|---|---|---|
| CL | 2469-2003 | | 9/2004 | |
| CL | 190-2004 | | 11/2004 | |
| CL | 483-2008 | | 4/2008 | |
| DE | 9309236 | | 10/1993 | |
| EP | 1667541 | A1 * | 6/2006 | A24F 23/04 |
| EP | 1930253 | | 6/2008 | |
| EP | 2210508 | A1 * | 7/2010 | |
| EP | 2236433 | A1 * | 10/2010 | B65D 43/02 |
| FR | 2623166 | A1 | 5/1989 | |
| FR | 2623166 | A1 | 5/1989 | |
| GB | 2291864 | | 2/1996 | |
| WO | 0151378 | | 7/2001 | |
| WO | 2005/016036 | | 2/2005 | |
| WO | WO 2005/016036 | * | 2/2005 | A24F 23/04 |
| WO | WO2005016036 | A1 | 2/2005 | |
| WO | WO2006096117 | A1 | 9/2006 | |
| WO | 2006/096117 | | 10/2006 | |
| WO | 2008135468 | | 11/2008 | |

OTHER PUBLICATIONS

International Preliminary Report on Patentability corresponding to PCT/EP2009/064284 mailed Dec. 29, 2010.

International Search Report and Written Opinion mailed Jan. 25, 2010 corresponding to International Application PCT/EP2009/064363, filed Oct. 30, 2009.

International Preliminary Report on Patentability mailed Nov. 16, 2010 corresponding to International Application PCT/EP2009/064363, filed.

Office Action for corresponding application CL2011-001387, filed Jun. 98, 2011.

* cited by examiner

CONTAINER

CLAIM FOR PRIORITY

This application is a National Stage Entry entitled to and hereby claims priority under 35 U.S.C. §§365 and 371 to corresponding PCT Application No. PCT/EP2009/064284, filed Oct. 29, 2009, which in turn claims priority to British Application Serial No. GB 0821686.3, filed Nov. 28, 2008. The entire contents of the aforementioned applications are herein expressly incorporated by reference.

The present invention relates to a container for tobacco products, preferably smokeless products and most preferably snus.

Current packing for tobacco products such as snus and snuff comprises a box for holding the product and a resealable lid to maintain its freshness. Some tobacco products including snus are discarded after use, preferably in a suitable place such as a bin or the like to avoid littering. However, littering of tobacco products is a common problem as its consumption is not always restricted to a designated area and so a user may not always be in the vicinity of a bin when they need to dispose of the consumed tobacco product.

To overcome the above mentioned problem, it is known from WO 2005/016036 A1 and WO 2006/096117 to provide a container for holding fresh snus with a separate compartment for temporarily receiving consumed snus. The compartment is defined by a recess in the lid to which a cover is connected via a hinge. The use of a hinge formed in the lid with corresponding hinge part formed on the cover to couple the cover to the lid limits the range of materials which may be used for the container and also results in relatively complex container, both of which limit the ease of manufacturing and cost effectiveness. These types of containers are also prone to accidental opening as they rely on a portion of the cover being snapped into the recess so as to secure the snus in the disposal compartment.

A container having a second compartment wherein the cover is detachable such that the cover and lid are not connected via a hinge is also known. The cover of such a container is clipped onto the lid however, the clipping function is reduced with the repeated removal and attachment of the cover due to wear and so the cover may accidentally detach from the lid causing the discarded snus to fall out.

The present invention seeks to provide a container for snus that overcomes or substantially alleviates the problems mentioned above.

According to the present invention, there is provided a container comprising two portions that together define a first compartment for storing fresh snus and having a second separate storage compartment with a cover for storing used snus, said cover being attachable to one of said portions to close said second compartment, wherein the two portions are attachable to each other to close the first compartment, and/or the cover is attachable to one of said portions to close the second compartment, by a magnetic force.

Preferably, one portion is at least partially formed from or contains a material susceptible to magnetic force.

Conveniently, the other portion includes or is at least partially formed from a magnetic material such that the two portions are magnetically attracted to each other.

Preferably, the cover is attachable to said one portion and includes or is at least partially formed from a magnetic material such that the cover is magnetically attracted to said one portion.

The cover may be attached to said other portion and includes or is at least partially formed from or contains a material susceptible to magnetic force so that the cover is magnetically attracted to said other portion.

Conveniently, the two portions comprise a lid and a base.

Preferably, the base comprises a bottom and a peripheral wall with an inner surface which is lined with a plastic component extending beyond said wall.

The lid may be retained on the base by the lid frictionally engaging with the extending part of the plastic component.

Preferably, the second storage compartment comprises a central recess in one of said portions.

In one embodiment, the central recess is encircled by an outer recess having a depth less than that of said central recess and configured to receive the cover.

In an alternative embodiment, the second storage compartment comprises a plurality of compartments.

Conveniently, the cover comprises a plurality of corresponding cover portions, each cover portion covering a separate compartment of said plurality of compartments.

Preferably, the container comprises a film releasably attached to a top of the base to enclose the first compartment.

Conveniently, the film is adhesively adhered to the top of the base.

The first compartment may contain snus.

Embodiments of the present invention will now be described by way of example only, with reference to the accompanying drawings, in which.

Figure 1:
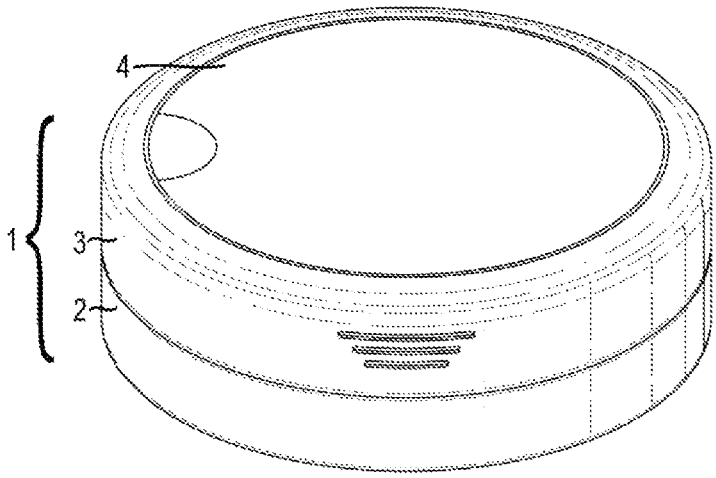
FIG. 1 shows a perspective view of a snus container according to the present invention.
Figure 2:
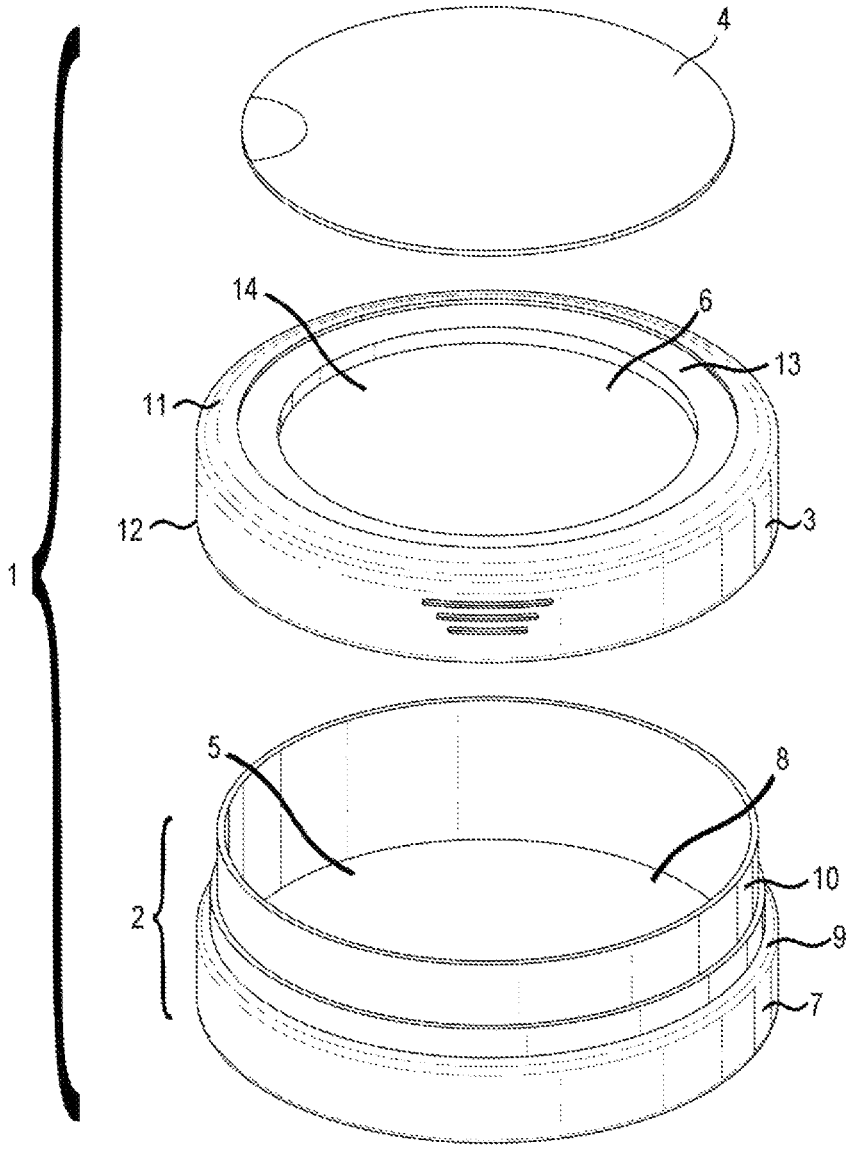
FIG. 2 shows an exploded view of the three components of the snus container in FIG. 1.
Figure 3:
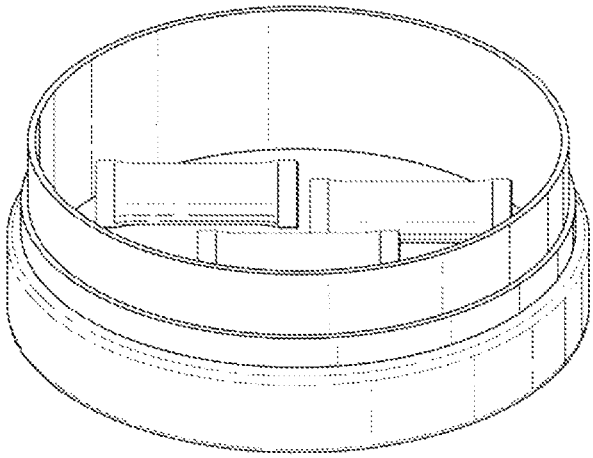
FIG. 3 shows fresh snus in a component of a snus container according to an embodiment of the present invention.

Referring now to the drawings, there is shown in FIGS. 1 and 2 a container 1 comprising a housing 2, a lid 3 and a cover 4. The housing 2 and the lid 3 define a main storage space or a first compartment 5 for holding fresh snus (e.g., as shown in FIG. 3). The lid 3 and the cover 4 define a secondary storage space or compartment 6 for holding consumed snus.

The housing 2 comprises a base 7 having a bottom 8 and a side wall 9 which circumferentially extends upwards from the bottom 8, a plastic component or ring 10 which is provided within the base 7 and aligned with the side wall 9 of the base 7 so that the outer diameter of the ring 10 is equal to the inner diameter of the side wall 9 of the base. The ring 10 is designed to extend beyond the height of the side wall 9 of the base for reasons described below.

The lid 3 includes a side wall 12 which extends vertically from a top 11 of the lid 3. The thickness of the side wall 12 and the diameter of the top 11 are of similar dimensions as the side wall 9 and bottom 8, respectively, of the base 7. The container 1 is closed as the base 7 receives the lid 3 so that their walls 9 and 12 abut and thereby seal the space 5 defined therein. As the lid 3 is positioned on the base 7 its side wall 12 encloses the extending part of the ring 10 which results in a limited movement of the lid 3 relative to the base 7. It is envisaged that the base 7 and the lid 3 of the container are manufactured from pressed metal with magnetic properties so that the lid and the base are magnetically closeable. However, the base 7 and the lid may be manufactured using other materials having magnetic properties or, at least a region of the lid and/or base 3,7 that come into contact may be provided with an element, particles or component embedded into or adhered onto the lid and/or base 3,7 that possesses magnetic properties.

In an alternative embodiment, materials with no magnetic properties may be employed and so the container may rely on friction or interference between the lid and the plastic component or ring to maintain the seal.

The top 11 of the lid 3 further comprises two distinct recesses 13, 14 of different depths. The outer or annular recess 13 is of a depth similar to the thickness of the cover 4 so that by positioning the cover 4 in the annular recess 13 a flush outer finish of the lid 3 is produced. The diameter of the cover 4 is slightly smaller than the diameter of the annular recess 13 so that there is a gap provided for assisting in the removal of the cover 4. The annular recess 13 encircles a central recess 14 which is of a greater depth. When the cover 4 is placed in its receiving annular recess 13 a secondary storage space 6 for holding or storing consumed snus is defined by the central recess 14 and the cover 4.

The cover 4 is secured in the receiving annular recess 13 by magnetic forces provided by the materials used for the lid 3 and the cover 4 or by a magnetic component or particles in the region of the connection between the lid 3 and cover 4. This allows for the cover 4 to be releasably attached to the lid 3 so that consumed snus may be accumulated and securely held in the space 6 until it may be discarded. Preferably, the cover 4 will be made out of pressed metal similarly to the base and lid.

It will be appreciated that the container may alternatively be made out of plastic with incorporated magnets so that the container has the material and manufacturing advantages of plastic but possess magnetic properties allowing for the container to remain closed. For example, a separate magnet may be stuck or otherwise embedded into the lid 3 and/or cover 4.

Although the device has been described to include a receiving recess in which the cover sits, it should be realised that the magnetic cover may be attached to a lid 3 without a receiving recess so that the cover 4 sits proud of the lid 3.

Figure 4:
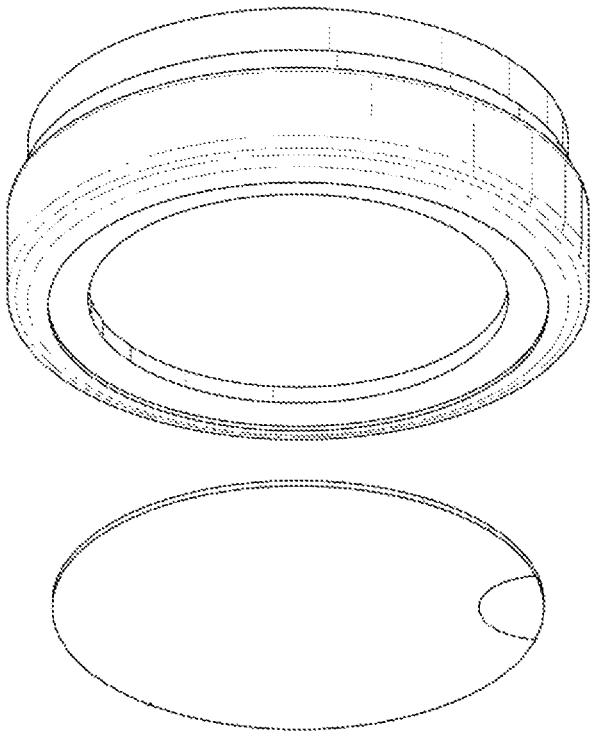
FIG. 4 shows components of a snus container according to an embodiment of the present invention.

In an alternative embodiment of the present invention, shown in FIG. 4, the bottom wall of the base comprises a recess receiving a cover as previously described so as to define a second compaitment for holding used snus. The cover is releasably attachable to the base by magnetic forces wherein either the cover or the base comprises at least a region provided with magnetic properties and the corresponding component is formed from metal or alternatively both components include at least a region having at least one magnet.

In a further modification, both the lid and the base may be provided with a recess and the user may then have the option of whether to dispose snus in the recess of the lid, the base or even in both the lid and the base. In this configuration all of the components may comprise at least a region having magnetic properties or there may be a combination in which some components are metallic and the remaining components possess magnet properties.

Figure 5:
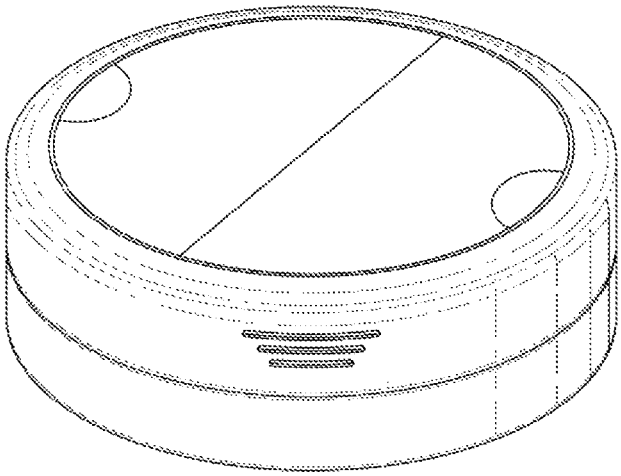
FIGS. 5 and 6 show components of a snus container according to an embodiment of the present invention.
Figure 6:
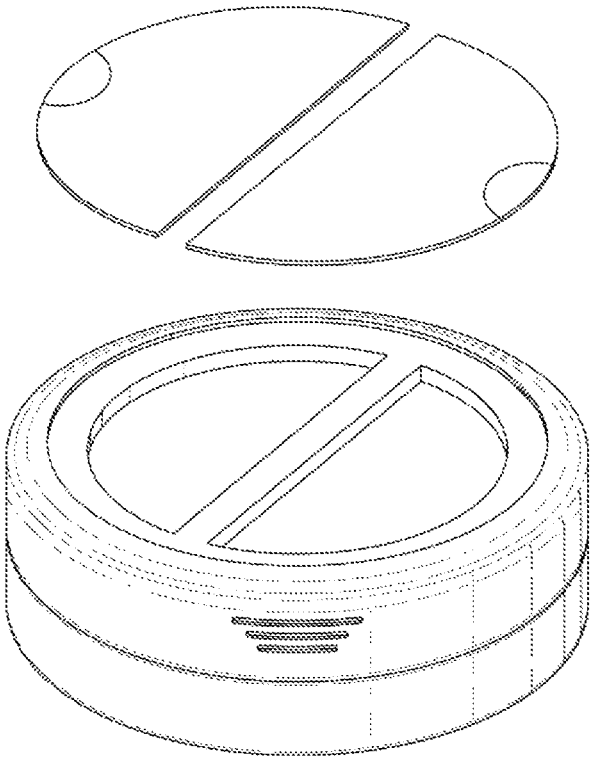

In an alternative embodiment, the space 6 holding consumed snus may be divided into a plurality of compartments or spaces and so the cover may also be divided into corresponding portions or the cover may seal all compartments, as illustrated in FIGS. 5 and 6.

It should be realised that the container may assume a wide variety of shapes or that some components of the container will be shaped differently to the remaining components. For example, the cover 4 may assume a different shape to the lid 3 and the annular recess providing that the horizontal dimensions of the cover 4 fall within the boundaries of the annular recess. Alternatively, the outer boundaries of the annular recess may correspond to a non-circular cover.

Figure 7:
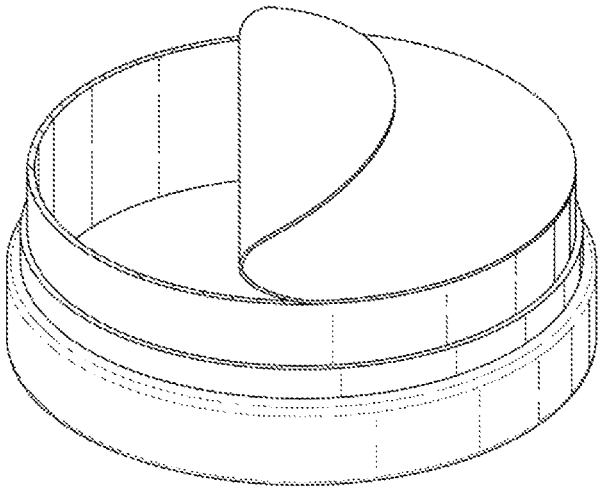
FIG. 7 shows components of a snus container according to an embodiment of the present invention.

In another embodiment, shown in FIG. 7, a resealable adhesive film or label may be attached to the top of the base so as to improve the freshness of the snus. It is envisaged that the film may be resealable or immediately disposed of as the first portion of snus is retrieved.

The embodiments of the present invention in combination with the material used allows for the manufacturing costs to be reduced in comparison to containers where the cover is attached to the lid via a hinge. Moreover, the magnetic properties of the container provides advantages over containers comprising a cover that clips onto the lid as the magnetic forces reduces accidental opening of the second compartment and maintain an improved seal following repeated detachment of the covet 4 from the lid 3.

Although embodiments of the invention have been shown and described, it will be appreciated by those skilled in the art that variations may be made to the above exemplary embodiments that lie within the scope of the invention, as defined in the following claims.

The invention claimed is:

1. A container comprising:

first and second portions that together define a fresh snus first storage compartment, one portion of the container including a first recess formed in an outer surface thereof defining a second separate used snus storage compartment; and a removable cover releasably attachable to said one portion to close said second separate used snus storage compartment, wherein the first recess is encircled by an outer recess having a flat bottom face and a depth less than that of the first recess and configured to receive the removable cover such that the removable cover is flush with the outer finish of the one portion;

wherein at least one of said one portion and the removable cover includes a magnetic material and the other of said one portion and the removable cover includes material susceptible to magnetic force such that the removable cover is magnetically detachable from said one portion to open the second separate used snus storage compartment;

wherein one of the first and second portions comprises a lid and the other of the first and second portions comprises a base;

wherein the first recess is formed in the base; and wherein the base comprises a bottom and a peripheral wall with an inner surface which is lined with a plastic component that is a separate component to the base, said plastic component extending beyond said peripheral wall in a direction away from the bottom wall.

2. The container according to claim 1, wherein each of the first and second portions includes at least one of a magnetic material and a material susceptible to magnetic force such that the first and second portions are attachable to each other to close the fresh snus first storage compartment by magnetic force.

3. The container according to claim 1, wherein the first portion is at least partially formed from a material susceptible to magnetic force.

4. The container according to claim 3, wherein the second portion includes a magnetic material such that the two portions are magnetically attracted to each other.

5. The container according to claim 3, wherein the removable cover is attachable to the first portion and includes a magnetic material such that the removable cover is magnetically attracted to the first portion.

6. The container according to claim 4, wherein the removable cover is attached to said second portion and includes a material susceptible to magnetic force such that the removable cover is magnetically attracted to said second portion.

7. The container according to claim 1, wherein the lid is retained on the base by the lid frictionally engaging with the part of the plastic component extending beyond said peripheral wall.

8. The container according to claim 1, wherein the second separate used snus storage compartment comprises a central recess in one of said two portions.

9. The container according to claim 1, wherein the second separate used snus storage compartment comprises a plurality of compartments.

10. The container according to claim 9, wherein the second separate used snus storage compartment comprises a plurality of cover portions, each cover portion covering a separate compartment of said plurality of compartments.

11. The container according to claim 1, comprising a film releasably attached to a top of a base to enclose the fresh snus first storage compartment.

12. The container according to claim 11, wherein the film is adhesively adhered to the top of the base.

13. The container according to claim 1, wherein the fresh snus first storage compartment contains snus.

14. The container according to claim 3, wherein the second portion is at least partially formed from a magnetic material such that the two portions are magnetically attracted to each other.

15. The container according to claim 3, wherein the removable cover is attachable to said first portion and is at least partially formed from a magnetic material such that the removable cover is magnetically attracted to said first portion.

16. The container according to claim 4, wherein the removable cover is attached to said second portion and is at least partially formed from a material susceptible to magnetic force such that the removable cover is magnetically attracted to said second portion.

17. The container according to claim 4, wherein the removable cover is attached to said second portion and contains a material susceptible to magnetic force such that the removable cover is magnetically attracted to said second portion.

* * * * *

UNITED STATES PATENT AND TRADEMARK OFFICE

CERTIFICATE OF CORRECTION

PATENT NO. : 8,701,881 B2
APPLICATION NO. : 13/131510
DATED : April 22, 2014
INVENTOR(S) : Paul Gibson and Aaron McKenzie It is certified that error appears in the above-identified patent and that said Letters Patent is hereby corrected as shown below:

On the Title Page

Item (56) OTHER PUBLICATIONS

"064363, filed." should read -- 064363, filed October 30, 2009. --

"June 98, 2011." should read -- June 8, 2011. --

Signed and Sealed this
Twenty-sixth Day of August, 2014

Michelle K. Lee

Michelle K. Lee
*Deputy Director of the United States Patent and Trademark Office*